US005893523A

United States Patent [19]

Irwin

[11] Patent Number: 5,893,523

[45] Date of Patent: Apr. 13, 1999

[54] APPARATUS FOR COMMINUTING WASTE MATERIALS HAVING FEED ROLL DELIVERY FEATURES

[75] Inventor: Jere F. Irwin, Yakima, Wash.

[73] Assignee: Irwin Research & Development, Inc., Yakima, Wash.

[21] Appl. No.: 08/876,033

[22] Filed: Jun. 13, 1997

[51] Int. Cl.[6] ..... B02C 18/22

[52] U.S. Cl. ..... 241/60; 241/73; 241/80; 241/97; 241/166; 241/225; 241/236

[58] Field of Search ..... 241/225, 166, 241/167, 34, 80, 97, 60, 236, 73

[56] References Cited

U.S. PATENT DOCUMENTS

| | | | |
|---|---|---|---|
| 2,595,117 | 4/1952 | Ahlmann . | |
| 3,055,597 | 9/1962 | Mund . | |
| 3,229,698 | 1/1966 | Johansson et al. . | |
| 3,310,059 | 3/1967 | Grinzinger . | |
| 3,627,211 | 12/1971 | Leach . | |
| 4,161,296 | 7/1979 | Parker et al. . | |
| 4,321,027 | 3/1982 | Stoehr et al. . | |
| 4,355,766 | 10/1982 | Wigand . | |
| 4,422,581 | 12/1983 | Chryst . | |
| 4,687,144 | 8/1987 | Irwin et al. . | |
| 5,039,020 | 8/1991 | Leuthold et al. . | |
| 5,141,168 | 8/1992 | Pepper . | |
| 5,248,100 | 9/1993 | Arakawa | 241/225 |
| 5,427,321 | 6/1995 | Takahashi et al. | 241/225 |

FOREIGN PATENT DOCUMENTS

| | | | |
|---|---|---|---|
| 3614028 | 10/1987 | Germany . | |
| 1556745 | 4/1990 | U.S.S.R. . | |
| 745176 | 2/1956 | United Kingdom | 241/97 |
| WO 95/33566 | 12/1995 | WIPO . | |

*Primary Examiner*—Mark Rosenbaum
*Attorney, Agent, or Firm*—Wells, St. John, Roberts, Gregory & Matkin, P.S.

[57] ABSTRACT

An apparatus for comminuting solid waste material comprises a frame having an enclosure with an entrance for initially receiving solid waste material; a set of overlapping scissor rolls rotatably mounted within the enclosure for shearing the waste material into subdivided pieces when the material passes between the scissor rolls; a feed roll rotatably carried by the frame for directing the waste material to the scissor rolls; and a separator screen carried by the frame in association with the at least one of the scissor rolls and having a plurality of apertures of a predetermined size for separating pieces having a size less than the predetermined size to pass therethrough to a shear outtake manifold for separation while preventing large subdivided pieces having a size greater than the predetermined size from passing therethrough.

16 Claims, 9 Drawing Sheets

10
100
43
102
104
II
II
17b
17a
18
50
24
30
16
17a
17b
88
89
35
33
34
78
32
36
89
79
81
17b
17a
16
22
162
166
17a
17b
148
176
160
41
163
170
172
180

APPARATUS FOR COMMINUTING WASTE MATERIALS HAVING FEED ROLL DELIVERY FEATURES

TECHNICAL FIELD

This invention relates to apparatus for comminuting solid waste materials such as plastic sheet material.

BACKGROUND OF THE INVENTION

During the manufacture and forming of many products from plastic, significant amounts of plastic waste material are frequently produced. Applicant has previously invented several unique apparatus for comminuting waste material, particularly plastic sheet material, into small, rather uniform particles or pieces that can be readily recycled or disposed of in an environmentally acceptable manner. Several generations of product line have been sold by Applicant under the product name "Chesaw" and have gained commercial success. One such prior invention is the subject of the Irwin, et al, U.S. Pat. No. 4,687,144 granted Aug. 18, 1987 and assigned to Irwin Research and Development, Inc. Another such prior invention directed to an improved device is the subject of Patent Cooperation Treaty (PCT) International Application PCT/US94/06412 published on Dec. 14, 1995, having International Publication No. WO 95/33566, and listing as Applicants (for all designated states except U.S.) Irwin Research and Development, Inc. Yet another such prior invention directed to an improved device is the subject of U.S. patent application Ser. No. 08/780,224 filed on Jan. 8, 1997 and assigned to Irwin Research and Development, Inc.

The first prior invention of U.S. Pat. No. 4,687,144 was a vast improvement over various types of hammermills that had previously been used. The hammermills were quite bulky, extremely noisy, and prone to substantial damage when the mill received foreign material that it could not comminute. Although such prior Irwin, et al, invention was a vast improvement and was commercially successful, particularly in view of hammermills, it was rather expensive to manufacture and sometimes noisy in operation when processing certain materials. Furthermore, it was unable to satisfactorily comminute rather high density plastic materials.

The improved prior invention of PCT Application No. PCT/U.S. 94/06412 was an improvement over the invention of U.S. Pat. No. 4,687,144. More particularly, an improved comminuting apparatus is taught which is able to produce significantly greater amounts of comminuted material in a given time. Furthermore, such device is less expensive to manufacture and quieter in operation. Even further, the apparatus provides an ability to comminute a wider variety of solid waste products. More particularly, the solid waste comminuting apparatus carries material that is severed in the device via an airstream to a fan. Subdivided pieces of material are directed via the fan to a separator screen which is mounted within a centrifugal housing. The airstream carries small pieces through the separator screen into an outer volute chamber for discharge from the apparatus. Large pieces which are not capable of passing through the separator screen are recycled through a recycle outlet and a recycle conduit back to scissor rolls of the device for further size reduction. However, the complexity of the apparatus and the number of parts needed to construct the apparatus was increased, which has proven undesirable for certain applications.

The improved prior invention of U.S. patent application Ser. No. 08/780,224 was an improvement over the inventions of U.S. Pat. No. 4,687,144 and PCT Application No. PCT/U.S. 94/06412. More particularly, a feed roll delivers solid waste material into overlapping scissor rolls at a desired line speed. A pneumatic conveyor in the form of an Archimedes screw delivers the subdivided pieces of comminuted material for sorting and reprocessing. However, the complexity of the apparatus and the number of parts needed to construct the apparatus was increased.

The object of the present invention is to provide a vastly improved comminuting apparatus that is not only able to process significantly greater amounts of material in a given time, it is better able to recirculate and sort severed solid waste material in the separator screen particularly in an apparatus having a simplified construction with fewer parts, proving more reliable, and is less costly to manufacture, maintain and repair. It is also better able to sever the material at a desired speed, or line speed, in a feed-controlled manner from a web of material being received from a processing machine. Accordingly, the present invention provides an apparatus that is able to feed solid waste material into the comminuting apparatus in a speed-controlled manner.

BRIEF DESCRIPTION OF THE DRAWINGS

Preferred embodiments of the invention are described below with reference to the accompanying drawings, which are briefly described below.

FIG. 7 is a product flow illustrated diagram showing the flow path of the waste material through the apparatus as the material is being progressively processed and reduced to the desired particulate size;

FIG. 10 is a cross-sectional view taken along line 10—10 in FIG. 4.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

According to one aspect of this invention, an apparatus for comminuting solid waste material comprises a frame having an enclosure with an entrance for initially receiving solid waste material; a set of overlapping scissor rolls rotatably mounted within the enclosure for shearing the waste material into subdivided pieces when the material passes between the scissor rolls; a feed roll rotatably carried by the frame for directing the waste material to the scissor rolls; and a separator screen carried by the frame in association with the at least one of the scissor rolls and having a plurality of apertures of a predetermined size for separating pieces having a size less than the predetermined size to pass therethrough to a shear outtake manifold for separation while preventing large subdivided pieces having a size greater than the predetermined size from passing therethrough.

According to another aspect of this invention, an apparatus for comminuting waste material into pieces having a size less than a predetermined size comprises a frame having an enclosure with an entrance opening for receiving the waste material; a set of overlapping scissor rolls rotatably mounted on the frame for shearing the waste material into smaller pieces as the material is passed between the scissor rolls; a feed roll for receiving the material from the entrance and directing the material between the scissor rolls; a screen carried by the frame within the enclosure in association with the scissor rolls, downstream of the feed roll, for permitting undersized smaller pieces of a size less than the predetermined size to pass therethrough and for preventing oversized smaller pieces of a size greater than the predetermined size from passing therethrough, the oversized smaller pieces being sheared into further subdivided pieces by passing between the scissor rolls; and a recycle manifold downstream of the scissor rolls and communicating with the feed roll, the recycle manifold configured to receive the subdivided pieces pass between the scissor rolls, at least some of the subdivided pieces being delivered to the feed roll where they are again directed between the scissor rolls.

Figure 4:
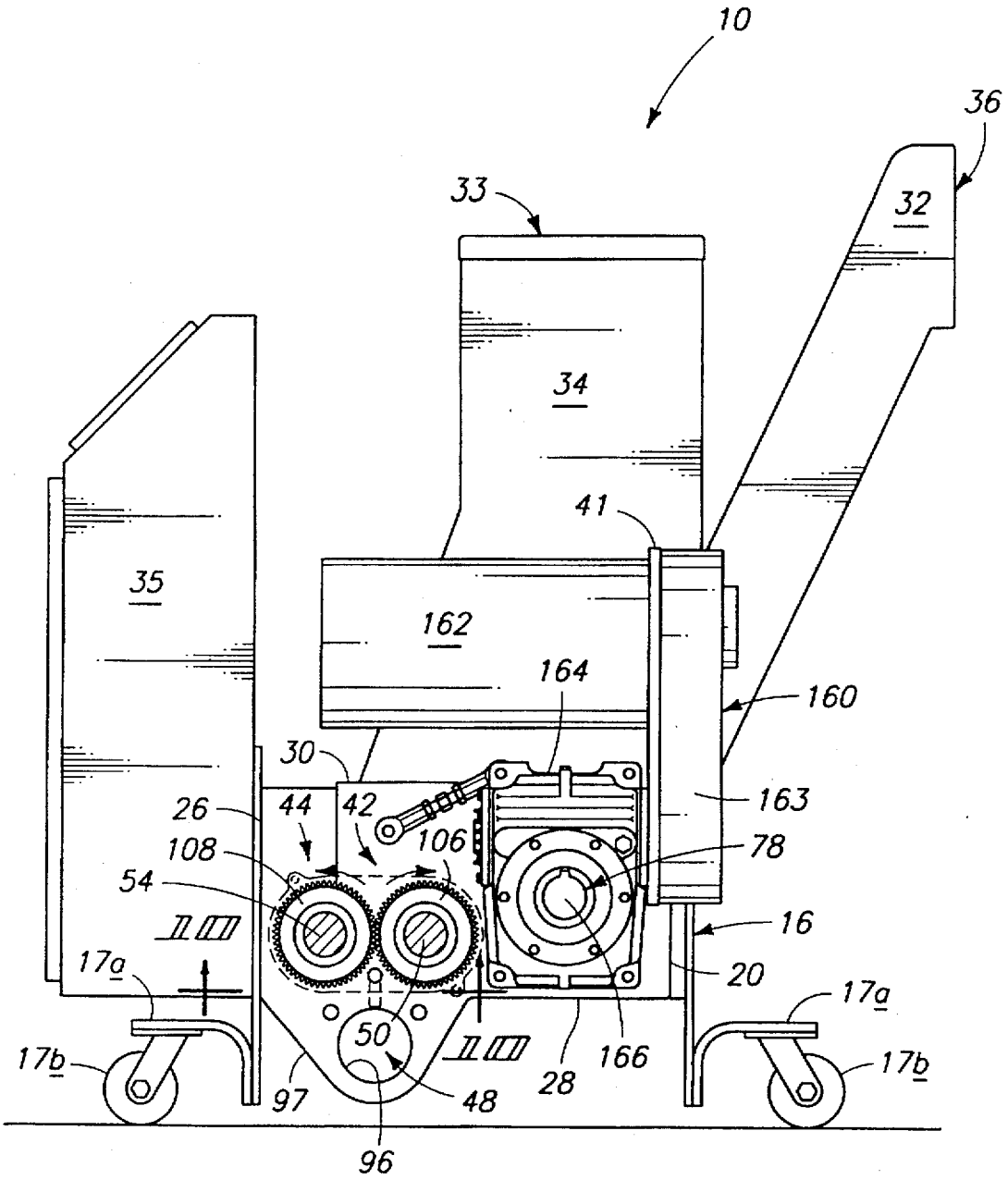
FIG. 4 is a left side view of the apparatus illustrated in FIGS. 1 and 2 with a scissor roll gear cover removed to illustrate co-rotating associated gears.
Figure 5:
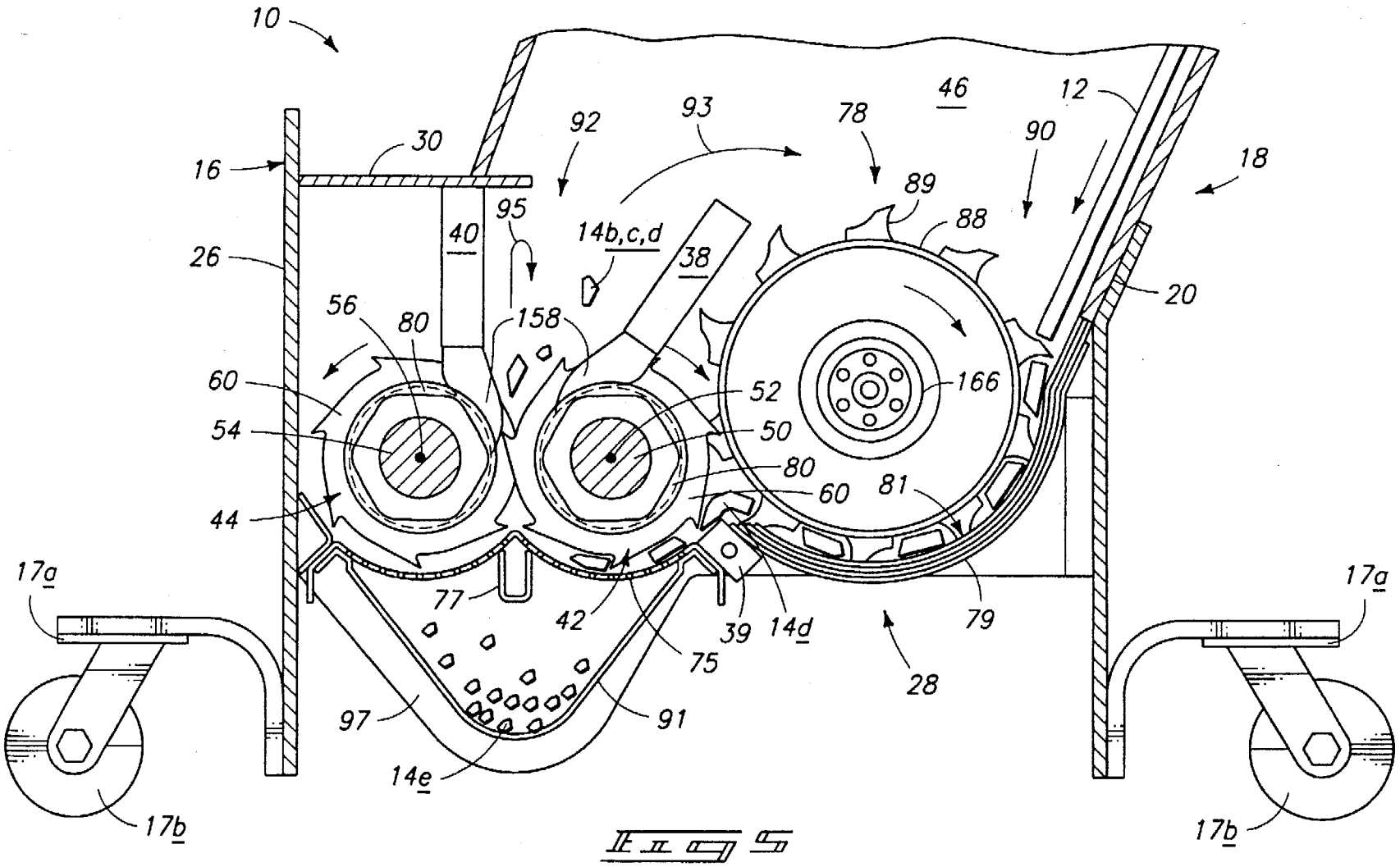
FIG. 5 is an enlarged transverse vertical cross-sectional and partial view taken along line 5—5 in FIG. 1 illustrating the interior of the apparatus.
Figure 6:
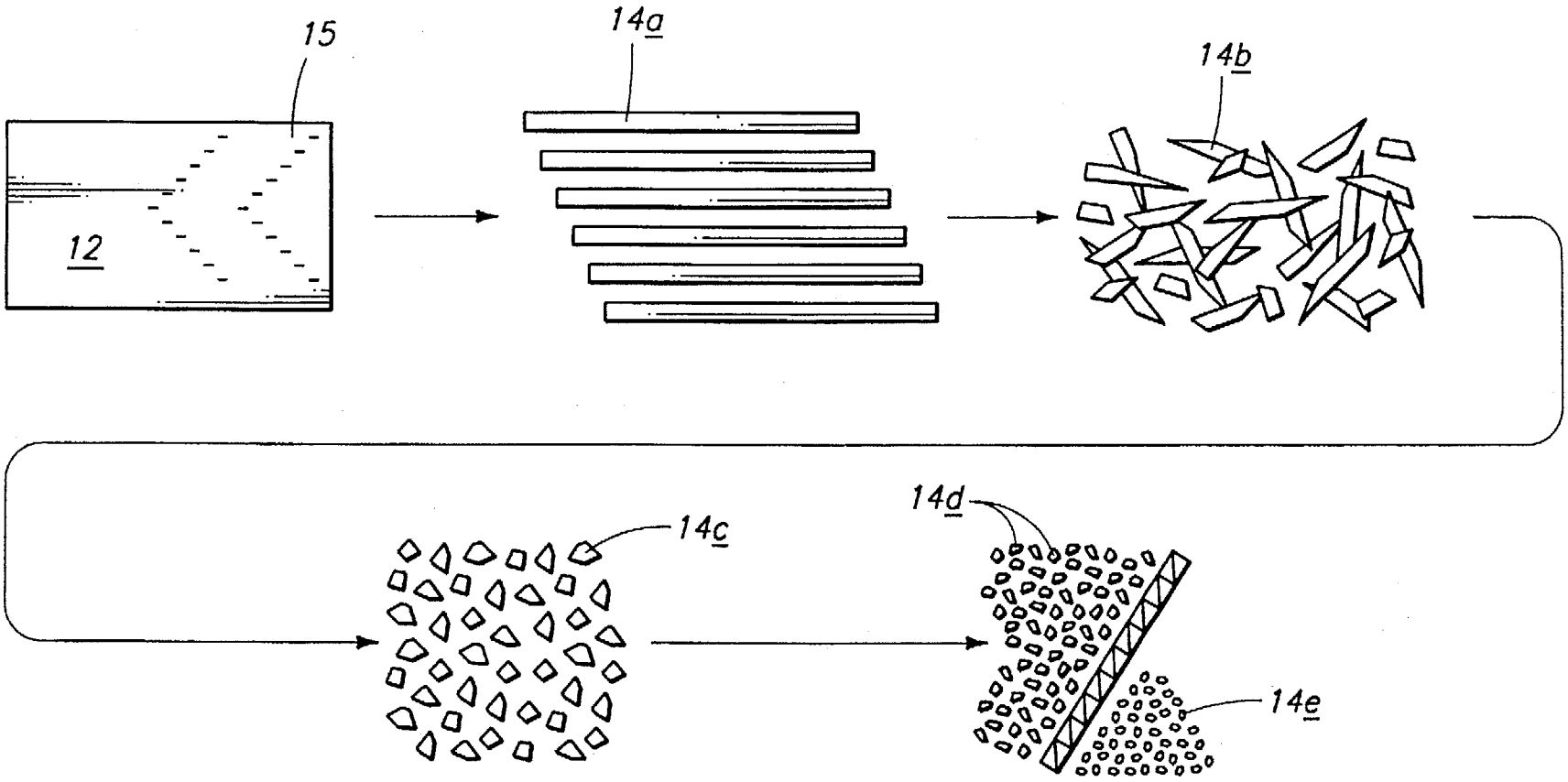
FIG. 6 is a series of illustration views of the waste material and the reduction of the waste material into smaller and smaller particles of the material as it is progressively processed and reduced to a desired particulate size.
Figure 11:
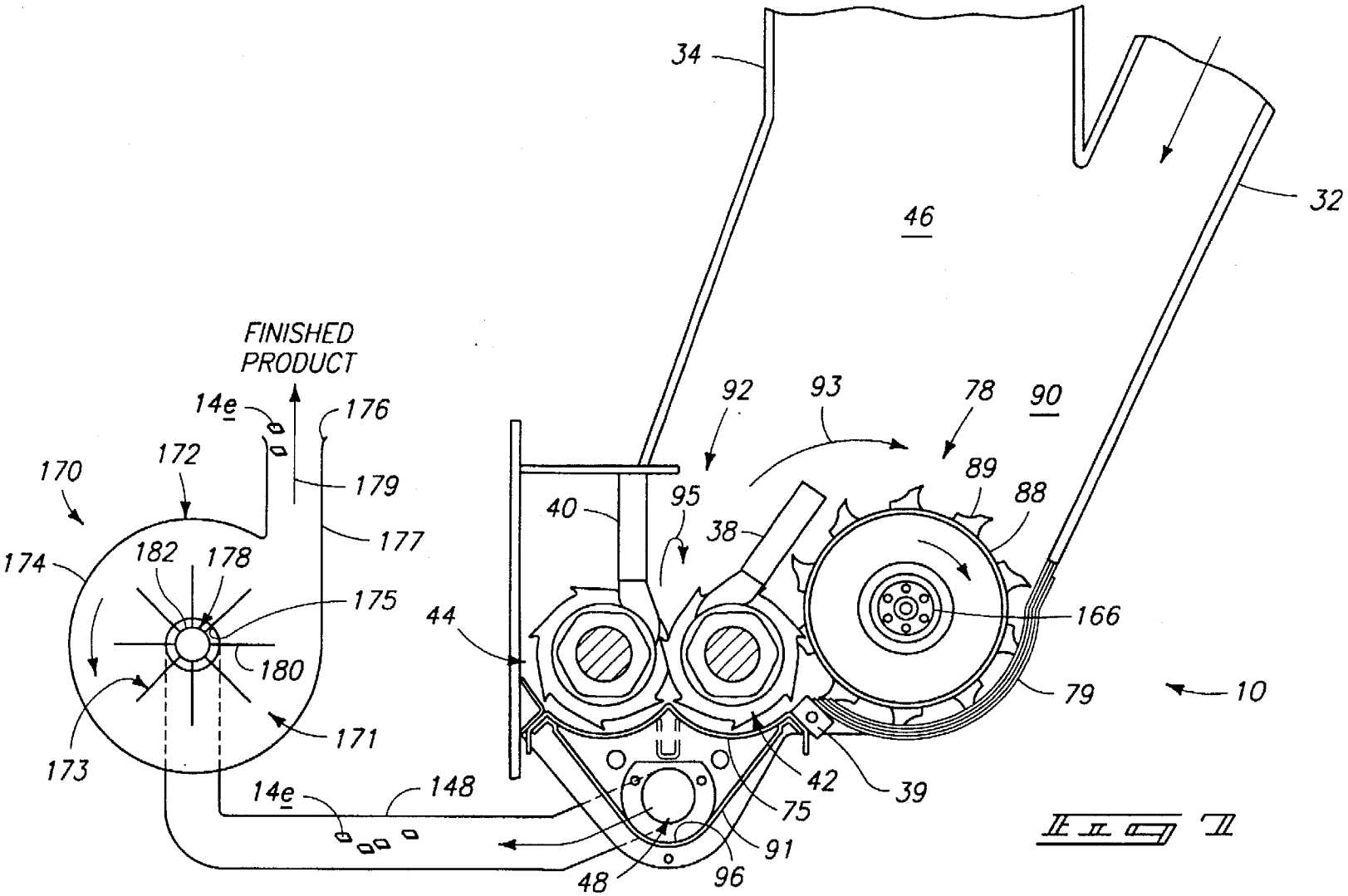

A preferred embodiment of the invention is illustrated in the accompanying drawings particularly showing a waste comminuting apparatus generally designated with the numeral 10 in FIGS. 1–5 for receiving solid waste material 12 and for reducing the solid waste material progressively into smaller and smaller sizes until the desired small particulate or piece size is obtained as illustrated in FIG. 6.

It should be noted that the apparatus 10 is very compact even though the material is progressively reduced in size in several stages to a desired predetermined small size. The predetermined small piece size will generally depend upon the desires of the customer, the end use, and the particular material being comminuted. The solid waste material 12, illustrated in FIG. 6, is progressively reduced to subdivided pieces 14*a* through 14*e*. When the subdivided pieces are generally reduced to the desired small size, 14*e*, they are removed from the apparatus as the final product. Those subdivided pieces that have not been sufficiently reduced to the desired small size are reprocessed or recycled until they are sufficiently reduced to the desired size.

The apparatus 10 has a general frame 16 that may be self-supported or affixed to other apparatus, such as the discharge of a thermal-forming machine, for receiving the solid waste material 12 directly from a thermal-forming machine and reducing the material for re-use. Frame 16 generally includes a general enclosure 18 that includes a front wall 20, side walls 22 and 24, a back wall 26, a bottom wall 28, and a top wall 30. Top wall 30 has first and second material receiving ducts 32 and 34 having a first material entrance 36 and a second material entrance 33, respectively (see FIGS. 1–4), through which the solid waste material is fed into apparatus 10. General frame 16 may be supported on legs 17*a* that each have individual pairs of wheels 17*b* at each end. General frame 16 preferably includes walls 20–30, upper frame members 38 and 40 and cross-member 39 that are variously illustrated in FIGS. 1–5.

Within the enclosure 18, two scissor rolls 42 and 44 are mounted in an intermeshing relationship for rotation in opposite directions in coordination with each other to receive the solid waste material 12 after being delivered via a feed roll 78, and to shear the solid material as the material passes between scissor rolls 42 and 44 (see FIG. 5). Feed roll 78 is supported at each end by a bearing similar to bearing 57 of FIG. 10. Scissor rolls 42 and 44 are positioned within enclosure 18 between an intake manifold 46 that receives the material through entrance 33 and/or entrance 36. The material, after passing through the scissor rolls from beneath, ascends into a recycle manifold 92 (see FIG. 5) that communicates with intake manifold 46 via recycle flow path 93.

Scissor roll 42 is mounted on a shaft 50 that rotates about axis 52 (see FIG. 5). Scissor roll 44 is mounted on a shaft 54 that rotates about axis 56. Axes 52 and 56 are parallel with each other, both in a horizontal plane, and extend between the side walls 22 and 24. Axes 52 and 56 are positioned so that scissor rolls 42 and 44 have sufficient overlap to shear the material between the scissor rolls as the material passes between the rolls. Shafts 50 and 54 are supported for rotation at each end by respective bearings 57 (see FIG. 10). Each of shafts 50 and 54 has hexagonal cross-sectional profiles, providing angular drive surfaces 58 (see FIGS. 8 and 9).

Figure 8B:
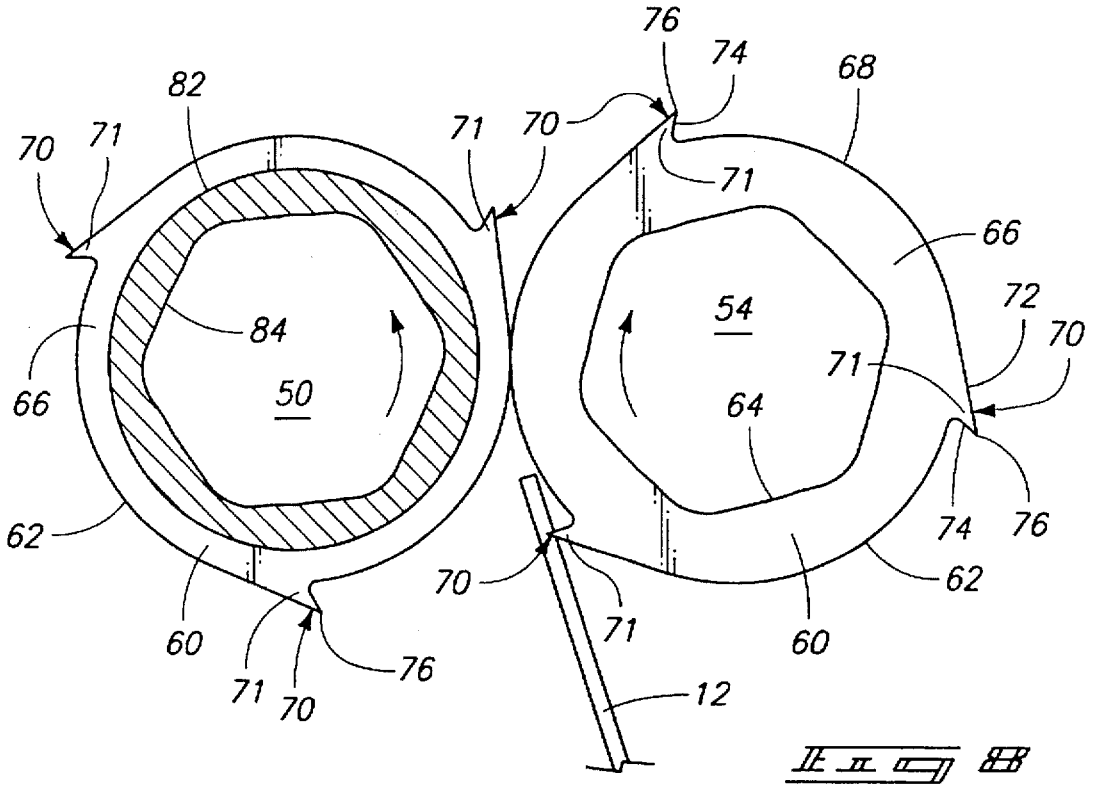
FIG. 8 is an isolated vertical cross-sectional view taken along line 8—8 in FIG. 10 of a set of scissor roll rings and feed gears on a servo feed roll illustrating the initial entrance and feeding of a piece of waste material between the scissor rolls.
Figure 9:
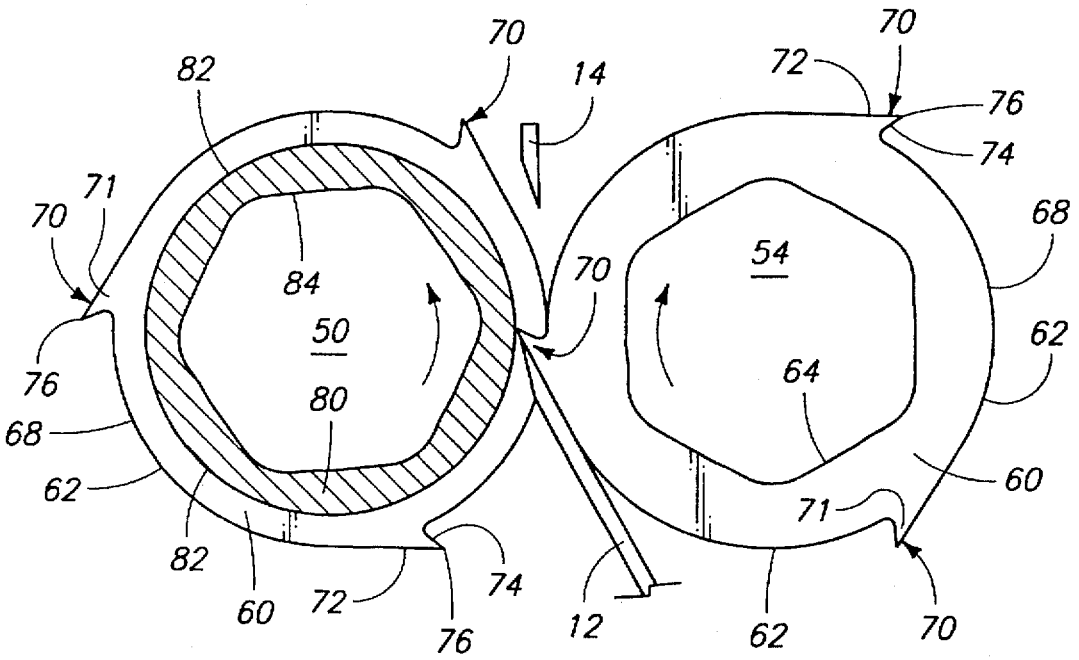
FIG. 9 is an isolated vertical cross-sectional view similar to FIG. 8 taken along line 9—9 in FIG. 10, except showing the scissor roll rings and feed gears incrementally rotated to feed and sever the piece of waste material.
Figure 11:
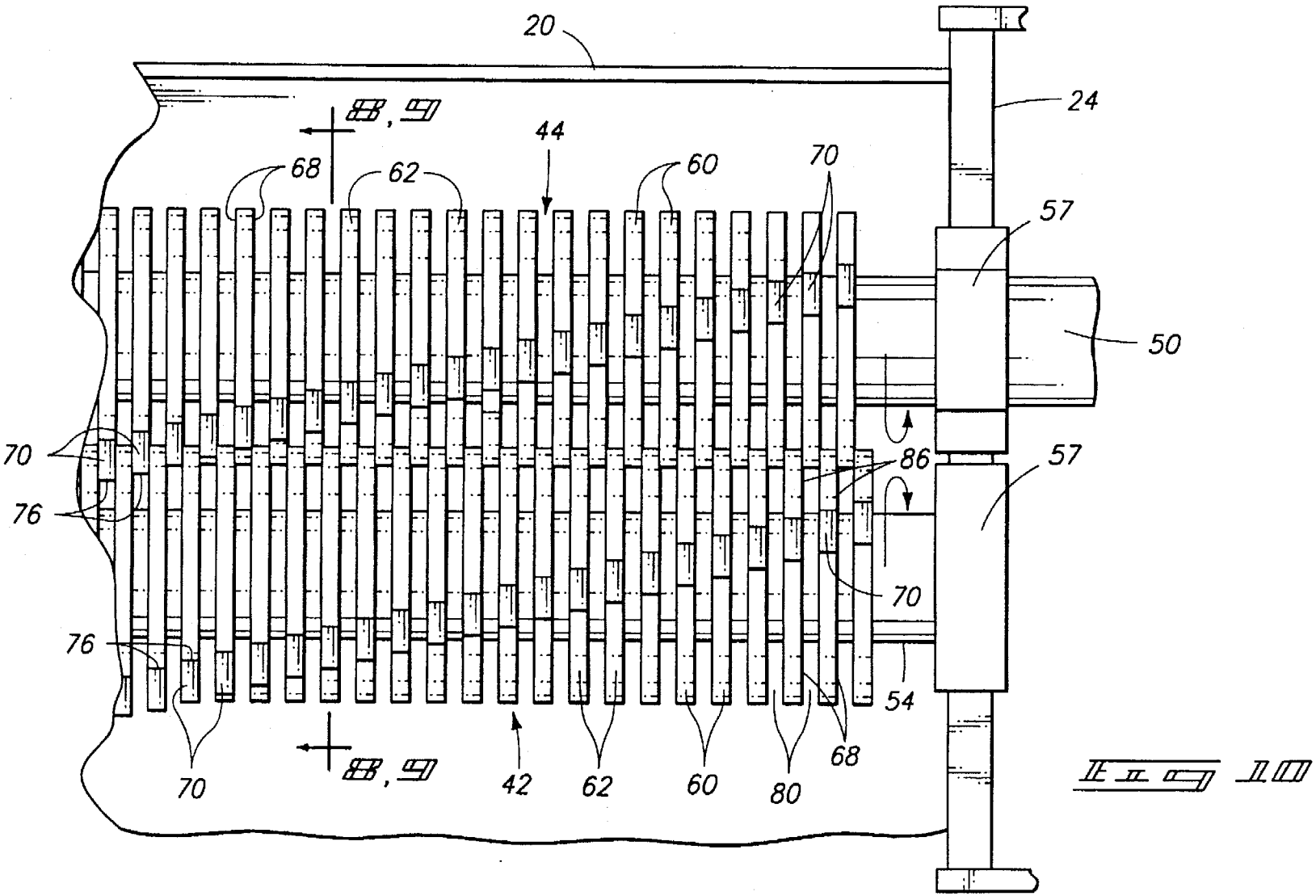

Each of scissor rolls 42 and 44 includes a plurality of scissor rings 60 in which each of the rings 60 has an outer circular peripheral surface 62 and an inner hexagonal bearing surface 64 that is complementary to the profile of shafts 50 and 54 so that the scissor rings 60 rotate in response to the rotation of shafts 50 and 54 (see FIGS. 8 and 9). Each of the scissor rings 60 includes side surfaces that form shearing edges 68 with the outer peripheral surface 62 (see FIG. 10).

In the preferred embodiment, each of scissor rings 60 has evenly angularly spaced finger knives 70 formed integrally on the scissor rings 60 and projecting radially outward of the surface 62 and forward in the direction of rotation for gripping, puncturing and transversely cutting the solid material 12 as illustrated in FIGS. 8 and 9. Each of the finger knives 70 includes a projecting body 71 that projects radially outward from the peripheral surface 62 and projects forward in the direction of rotation. Each of the finger knives 70 includes a side shearing surface 72 and an undercut surface 74, forming a sharp knife point 76. The scissor ring finger knives 70 are intended to grip, puncture and transverse the cuttage piece as it is being sheared between rings 60.

Each of th e scissor rolls 42 and 44 further include a plurality of ring spacers 80. Each spacer 80 has a circular outer peripheral surface 82 and an inner hexagonal surface 84 (see FIGS. 8 and 9). Circular outer peripheral surface 82 of each spacer 80 has a groove sized to receive the corresponding finger 158 of one of frame members 38 and 40 (see FIG. 5). The corresponding circumferential groove is not indicated with a reference numeral due to its relatively thin profile in order to facilitate simplification of the drawings. The corresponding groove is sized such that finger 158 is smoothly and cleanly received therein, preventing finger 158 from scraping the sides of each adjacent scissor ring 60.

Accordingly, each of the ring spacers 80 has a width that is slightly greater than the width of the spacer rings 60. Each of the spacer rings 60 and ring spacers 80 are alternately positioned on shafts 50 and 54 so that a scissor ring 70 on one scissor roll opposes a corresponding ring spacer 80 on the other scissor roll, creating a circular inter-roll cavity 86 (see FIG. 10) between the adjacent rings and outward of the intermediate ring spacers 80. Once the material 12 is cut and sheared, it is received in the inter-roll cavity 86 (see FIG. 10) and passes between rolls 42 and 44 into the recycling manifold 48.

The axes 52 and 56 of the rolls are sufficiently spaced so that there is a slight overlap of approximately one-eighth inch (⅛") in the profile of the scissor rings so that as they are rotated, the material is sheared by the shearing edges 68 and the finger knife 70 as a profile of the scissor ring 60 moves into the circular inter-roll cavity 86 of the opposing ring spacer 80 (see FIG. 10).

As shown in FIG. 5, once material 12 is cut and sheared by feed roll 78 and scissor rolls 42 and 44, it is carried into recycle manifold 92, which communicates with, and is formed in part by, intake manifold 46. Once cut and sheared material 12 collects in manifold 92 to a sufficient height, it cascades over the top portion of frame member 38, falling onto the top of feed roll 78, where it is recycled via flow path 93. In this manner, cut and sheared material is again fed via feed roll 78 back into scissor rolls 42 and 44 by passing it between feed roll 78 and feed plate 79 where individual teeth, or fingers, 89 along drum 88 of roll 78 convey and deliver sheet of material 12, along with recirculated cut and sheared material back to roll 42 for further delivery, sorting and/or severing.

Material 12, which has passed over flow path 93 and has been directed to feed roll 78, is thus recirculated via fingers 89 and feed plate 79 back to scissor roll 42, where it is reprocessed between rolls 42 and 44 for delivery back into recycling manifold 92. Particles **14*e* of sufficiently small size are separated out via a perforated plate, or separator screen, 75, which is provided immediately below and adjacent to rolls 42 and 44, conforming to their general nested bottom edge configuration. Here, screen 75 has the shape of a bi-concave perforated plate. Apertures in screen 75 are sized such that sufficiently small particles 14*e* drop through screen 75 where they are collected via a collector tray 91. A U-shaped cross-member 77 supports a central portion of screen 75 such that it is provided in close communication with each of rolls 42 and 44 along their feed entrance therealong. Collected particles 14*e*, present within tray 91, are then withdrawn through an outlet 96 (see FIG. 7) by way of a pneumatic conveyor 170. An air vent 59 is provided opposite outlet 96 as shown in FIG. 5 to ventilate outlet 96 when removing particles 14*e*. Particles 14*a–d* which are not sufficiently small enough to pass through screen 75 continue to be recirculated between rolls 42 and 44 via feed roll 78**.

Additionally, it has been discovered that some of the recirculated pieces **14*a–e* in recycle manifold 92 are sifted, or passed, in a reverse direction along flow path 95 where they fall backwards, or in reverse, between inner-roll cavities 86 (see FIG. 10) and return to screen 75. In this manner, particles which have sufficiently small size 14*e* are sifted by falling back via flow path 95 to screen 75 where they are collected in tray 91. Likewise, particles that fall back, but that are not sufficiently small in size, such as particles 14*a–d*, are passed down through rolls 42 and 44 where they are reprocessed and delivered upwardly to recycling via manifold 92, flow path 93 and intake manifold section 90**.

Feed plate 79, as shown in FIG. 5, is constructed from a plurality of laminated metal plates, with several top layers of the laminate having a plurality of slots 81 (see FIG. 1) such that teeth 89 on drum 88 are received in each respective slot 81 with a relatively narrow clearance. Accordingly, the individual plates are thin enough so that each can be formed by bonding, prior to fastening them together by welding or with fasteners. Feed plate 79 is carried along one end by front wall 20 and along an opposite wall by cross-member 39. Tray 91 is carried at one end by cross-member 39 and another end by wall 26. Similarly, screen 75 is carried at one end by cross-member 39 and another end by a bracket of wall 26, in addition to centrally located cross-member 77. Screen 75 and tray 91 are supported at each end by an end wall 97 which is formed by each of side walls 22 and 24. One end wall 97 contains outlet 96 (see FIG. 4) from which small particles **14*e* are withdrawn, and the other end wall 97 contains air vent 59 (see FIG. 3) which ventilates outtake manifold 48**.

Intake manifold 46 includes intake manifold section 90 and recycle manifold section 92, illustrated in FIGS. 5 and 7. New solid waste material 12 enters through one of material entrances 36 and 33 via an associated material receiving duct 32 and 34, respectively, and subdivided material requiring additional recycling is recirculated back into recycling manifold section 92 where it is re-delivered by way of recycle flow path 93, or it is alternatively returned via reverse sort path 95 for sifting in screen 75 or further severing and subdividing via rolls 42 and 44.

The outtake manifold 48 includes an outlet 96 (FIGS. 4 and 7) and a collection tray 91 with a pneumatic conveyor 170 facilitating the removal of the smaller-sized severed pieces **14*e* from the outtake manifold 48 and to entrain such pieces 14*e* in an airstream via an outtake pipe 148 (see FIG. 7) and pneumatic conveyor 170. Outtake pipe 148 provides an airstream conduit for directing an airstream with entrained subdivided pieces from the shear outtake manifold 48 to an outer volute duct 177 along flow path 179 to a product outlet 176 (see FIG. 8**).

Figure 1:
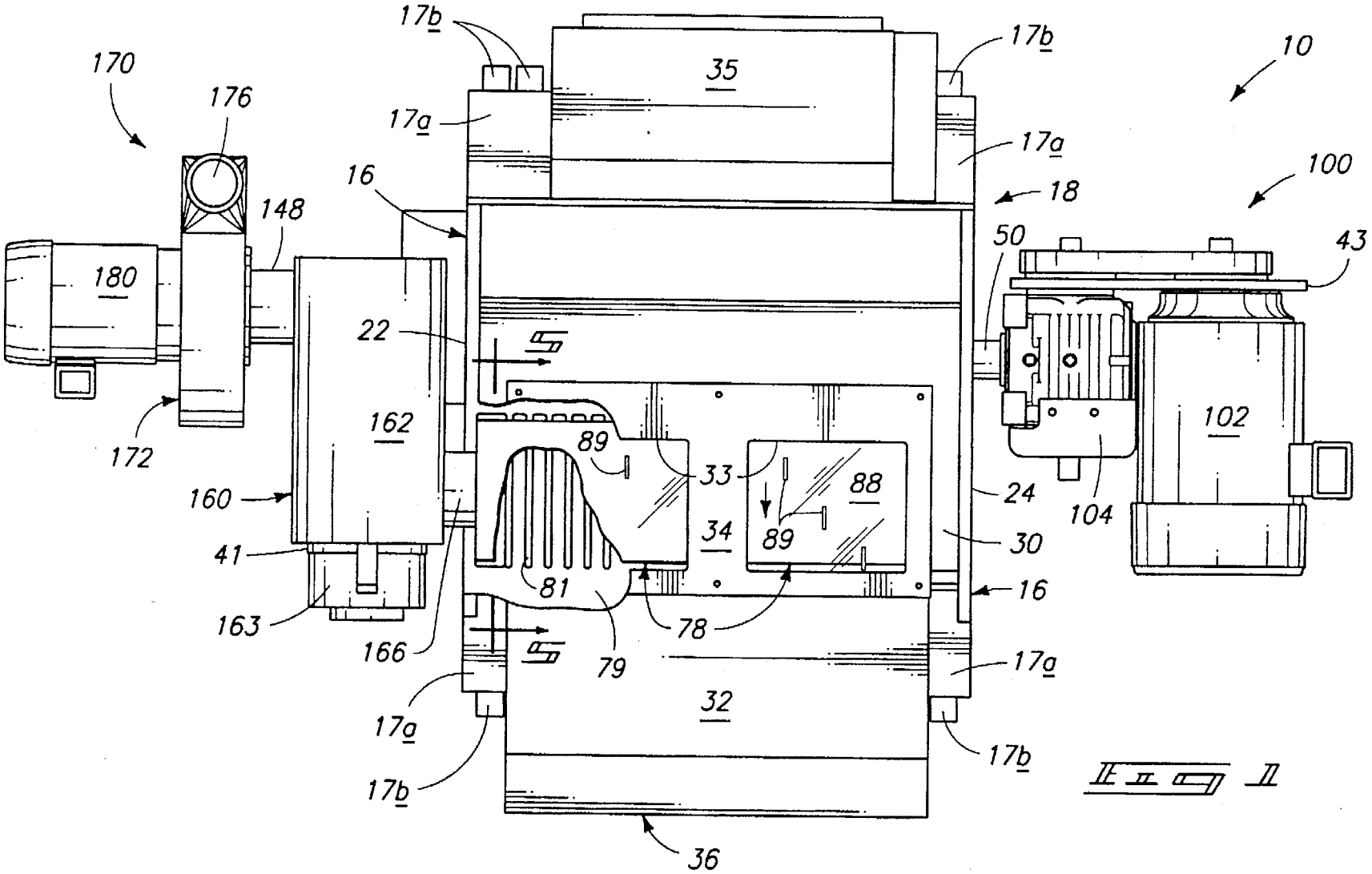
FIG. 1 is a plan view of a preferred embodiment of the apparatus illustrating the top exterior of the apparatus with one waste material entrance having a portion broken away to show the feed roll and feed plate.
Figure 2:
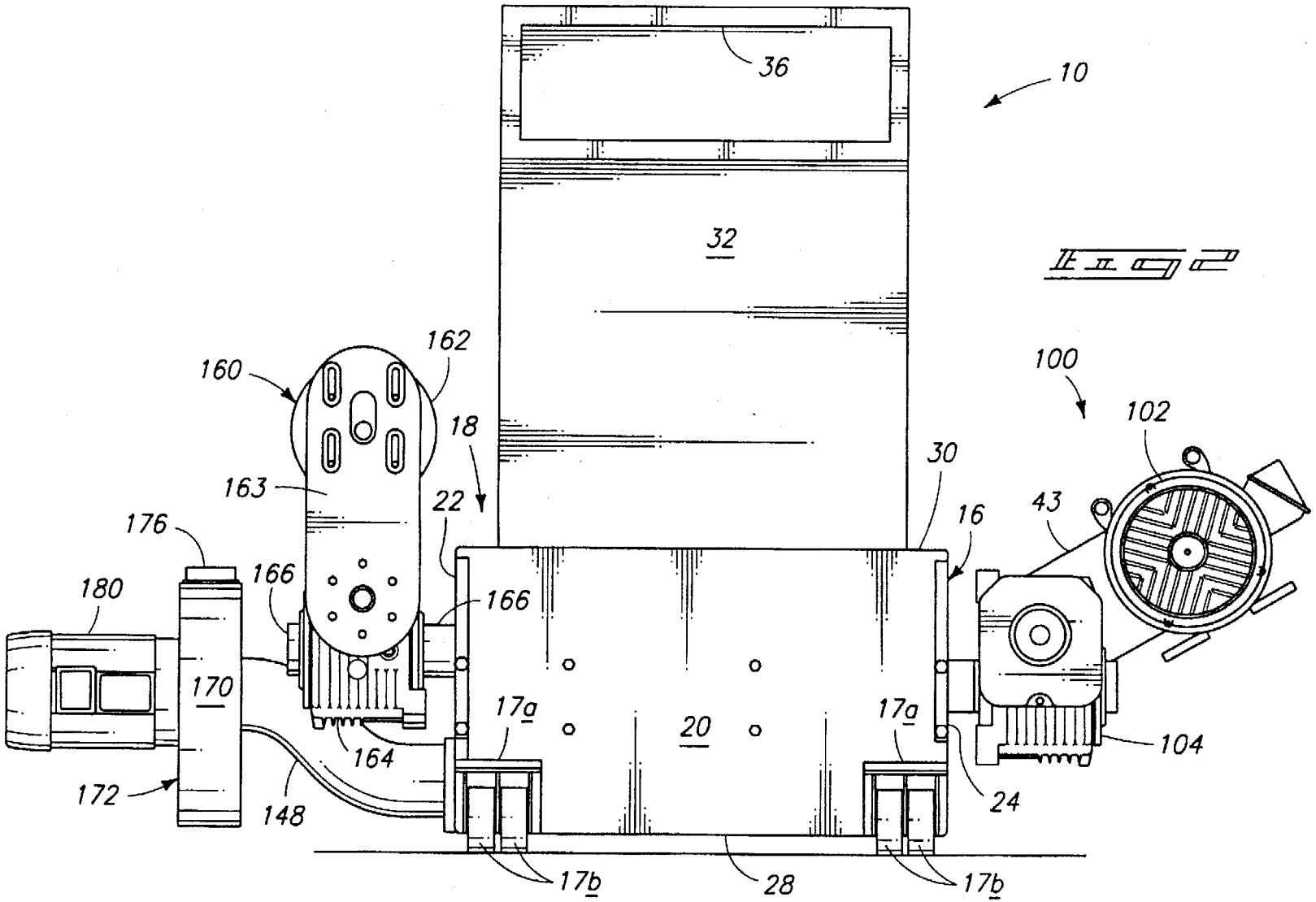
FIG. 2 is a front view of the apparatus illustrated in FIG. 1.
Figure 3:
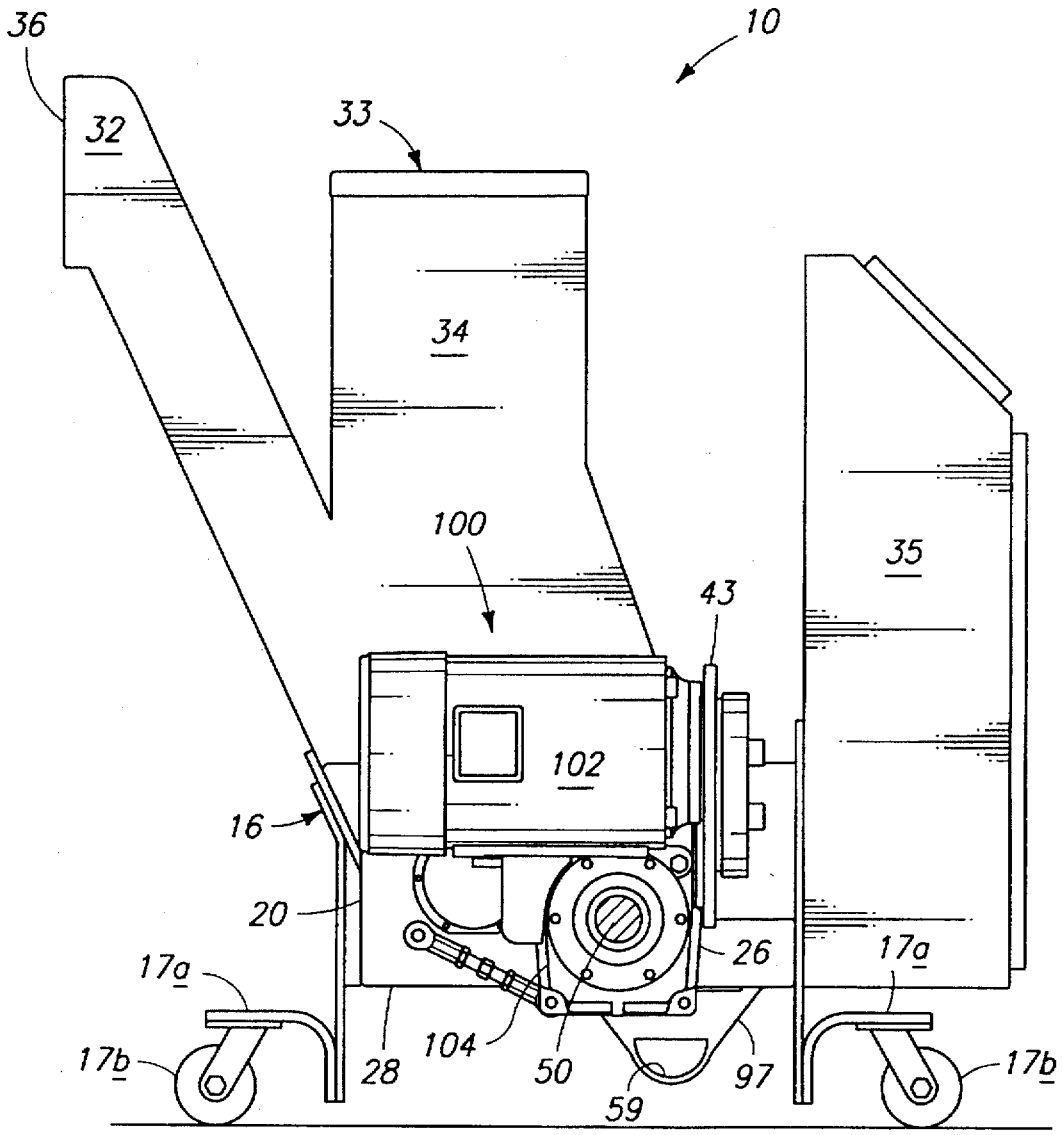
FIG. 3 is a right side view of the apparatus illustrated in FIGS. 1 and 2.

The apparatus 10 includes a scissor roll drive generally designated with the numeral 100 illustrated in FIGS. 1–3 having a motor 102 connected to a speed reduction gear box 104. The box 104 is operatively connected to shaft 50 for rotating, or driving, shafts 50 and 54 counter to each other in the directions illustrated in FIGS. 4, 5, 7 and 10. Shafts 50 and 54 are geared together for co-rotation as shown in FIG. 4.

Speed reduction gearbox 104 drives shaft 50 by way of motor 102 as shown in FIGS. 1–3. Motor 102 is supported by gearbox 104 by mounting plate 43. Gearbox 104 is secured to frame 16 by additional framework (not shown) to facilitate simplified viewing such as one or more struts tied to side wall 24 and frame 16. Scissor roll drive 100 includes a chain drive and a pair of sprockets which couple together motor 102 and gearbox 104 adjacent bracket 43. Alternatively, feed roll 78 can also be driven by scissor roll drive 100, either directly or by connecting it with one of the scissor rolls via sprockets and a connecting drive chain.

The apparatus 10 also includes a feed roll drive generally designated with the numeral 160 illustrated in FIGS. 1, 2 and 4 having a motor 162 connected to a speed reduction gearbox 164. The box 164 is operatively connected to shaft 166 for rotating feed roll 78 in the direction illustrated in FIGS. 1, 5 and 7. Motor 162 is carried by gearbox 166 via a mounting bracket 41 (see FIGS. 1 and 4). Motor 162 is coupled to drive gearbox 164 by way of a chain drive and a pair of sprockets contained within chain drive cover 163 along bracket 41.

According to one construction, motors 102 and 162 are each formed from a modern rotary electric servo motor drive, or actuating device. Such a drive includes an AC servo motor and an associated servo drive motor controller. For example, one suitable AC motor is sold be Siemens AG, Automation Group, Automation Systems for Machine Tools, Robots and Special-Purpose Machines, P.O. Box 31 80, D-91050 Erlangen, Federal Republic of Germany. Additionally, one suitable servo drive motor controller is sold by Siemens as an analog feed drive including the SIMODRIVE 611-A Transistor PWM Inverters and Motors for AC Feed Drives. Such a drive is a predictable device that can very accurately position a machine element to a desired position at a given time. Preferably, the associated servo motor is a brushless servo motor. Typically, only a nominal allowable following error (+/–FE) is produced by such a drive. Furthermore, activation of associated machine components can be triggered based on velocity or position of a drive, by using a velocity profile (or integrated displacement) of the drive.

Accordingly, feed roll 78 can be rotated at a desired line speed for a material 12 being received within apparatus 10, as shown in FIG. 5. For example, material entrance 36 can receive a web of material from a thermal-forming press (see FIG. 4) such that material 12 is drawn in via feed roll 78 substantially at a line speed according to FIG. 5 by actuating servo motor 162 at an appropriate speed. Preferably, scissor roll 42 is driven by a servo motor 102 (see FIG. 2) at a higher rotational speed. For example, a 2:1 or 3:1 drive ratio is suitable for many applications. As shown in FIG. 4, scissor roll 44 is driven for opposite rotation than scissor roll 42 by way of intermeshing gears 106 and 108, respectively. Gears 106 and 108 are provided at an end opposite from drive 100. In this manner, drive 100 drives shaft 50 for rotation, with shaft 54 being driven in co-rotation (opposite rotation, but journalled together), which causes scissor rolls 42 and 44 to comminute material presented therebetween.

The apparatus 10 further includes a pneumatic conveyor generally designated with the numeral 170 for conveying the subdivided pieces 14 from the outtake manifold 48 and directing the pieces to a product outlet 126 (see FIG. 7). Product outlet 126 ejects the pieces **14*e* where the sufficiently small subdivided pieces 14*e*** are collected in a storage vessel (not shown) for later recycling.

The pneumatic conveyor 170 includes a centrifugal fan 172 for generating an airstream of sufficient velocity and volume to remove the subdivided pieces from the shear outtake manifold 48 and to entrain the pieces **14*e* in the airstream (see FIGS. 5 and 7). The centrifugal fan 172, illustrated in FIG. 7, includes a housing 174 having a central propeller section 173, a peripheral volute section 171, and an outer volute duct 177. The central propeller section 173 includes a central inlet 175 with a propeller assembly 178 mounted within the central propeller section 173. The propeller assembly 178 includes a shaft 182 with radial blades 180 extending radially outward for directing the air from the central inlet 175 radially outward and tangential into the peripheral volute section 171. A motor 180 (see FIG. 1) is connected to the shaft 182 (see FIG. 7) for rotating the blades 180** at the desired speed to obtain an airstream having the desired velocity and volume.

Centrifugal fan 172 communicates with outer volute duct 177 and product outlet 176 for discharging the small particles **14*e*that have passed through the separator screen 75 via outtake pipe 148**.

As illustrated in FIGS. 5 and 8, the cross-frame members 38 and 40, each comprising a stripper plate, each have notched stripping fingers 158 formed on an edge thereof projecting between the scissor rings 60 and into the inter-roll cavities 86 along the lower profile of the scissor rolls 42 and 44 to strip any of the subdivided pieces from between the scissor rings 60 after the pieces have been severed. In one version, each finger is secured to each plate with a fastener. Each finger 158 rides in a complementary groove (not numbered) in the radial outer surface of ring spacer 80 (of FIG. 5).

During the operation of the apparatus 10, solid waste material 12 is fed into the apparatus 10 through one or more of the material entrances 32 and 34 (see FIGS. 1, 3 and 4) and into the intake manifold 46 where it is directed to the feed roll 78 (see FIGS. 5 and 7). Feed roll 78 then moves the material toward feed plate 79 as fingers 89, having sharp forward-leading edges, engage the material, pulling it between feed roll 78 and feed plate 79. The engaged material is delivered by fingers 89 passing along slots 81 (see FIG. 1) until it is brought into adjacent proximity with scissor roll 42. In some cases, fingers 89 can also help to sever material 12 during delivery to scissor roll 42. Scissor roll 42 then further engages the material, causing some of the material to rip and sever, as roll 42 is preferably rotating at a higher speed than roll 78. Roll 42 then delivers or circulates the material along screen 75 for sorting and between rolls 42 and 44 where it is engaged and severed.

As the delivered material engages rolls 42 and 44, it is gripped by the finger knives 70 and pulled between the scissor rolls 42 and 44, with the scissor rings 60 and its shearing edges 68 shearing the solid waste material into subdivided pieces. As previously mentioned, the finger knives 70 grip the material, puncture the material and transversely cut the material even further as it passes between the rolls. The severed pieces **14*a*–14*e* then ascend into the recycle manifold section 92. The stripper fingers 158 strip any severed pieces from the rolls 42, 44 and remove them into the recycle manifold section 92**.

After material and subdivided pieces **14*a*–*e* are delivered to scissor roll 42, scissor roll 42 in combination with scissor roll 44 further delivers the pieces along screen 75 where small subdivided pieces 14*e* are separated from the remaining material and pieces. Those subdivided pieces that are larger than the apertures or holes in the separator screen 75 are carried along rolls 42 and 44 where they are delivered between rolls 42 and 44 for further severing and subdividing, or comminuting. The further subdivided pieces are then delivered into recycle manifold section 92. Such further subdivided pieces 14*a*–14*e* are then either re-delivered via recycle flow path 93 onto feed roll 78 for further delivery and subdividing, or are received in a reverse direction via reverse-direction sort path 95 back along screen 75 where sufficiently small particles 14*e* are separated out through screen 75 and remaining portions are further subdivided between rolls 42 and 44. The small pieces 14*e* that pass through the separator screen 75 are directed from the apparatus through the product outlet 96 to a pneumatic conveyor 170 for delivery to final product outlet 176**.

The large particles or pieces **14*a*–14*e* will be continually recycled through intake manifold section 90 or via reverse-direction sort path 95 until their size is reduced below that of the preselected size of the apertures of the separator screen 75. Screen 75 can be easily replaced in order to provide apertures with a desired size for implementing a desired sort of particles. Screen 75** can be constructed from screen material or any suitable perforated sheet or plate, or other suitable construction.

Servo motor driven feed roll 78 is formed from a plurality of teeth, or fingers, 89 that are mounted for rotation on the outer face of drum 88 as shown in FIGS. 5 and 7. Teeth 89 are formed from thin pieces of plate metal having a sharp leading edge, each piece being welded to the radial outermost portion of drum 88. According to one construction, individual teeth 89 are laid across the face of drum 88 in two separate V-shaped patterns, as shown in FIG. 1. A second V-shaped pattern follows the first V-shaped pattern. Preferably, the outer surface of drum 88 contains fingers 89 such that, if the outer surface were rolled onto a planar sheet of paper, an array of teeth 89 would form two distinct V-shaped patterns of fingers 89 laid across the outer surface. The first V-shaped pattern is laid out on the first half semi-cylindrical portion of the drum outer surface, with the second V-shaped pattern being laid out on the remaining semi-cylindrical portion of the outer surface of drum 88. By providing fingers 89 in such a pattern, a web of material being received within material entrance 36 will engage feed roll 78 via fingers 89 such that the web of material will be pulled evenly along both edges between feed roll 78 and feed plate 79. Such feeding is important for cases where a web of material is pulled by feed roll 78 substantially at a line speed in order to prevent uneven pulling and jerking of the web of material which might otherwise affect processing of the web at an upstream processing station, or machine. For example, uneven pulling of a web of material by feed roll 78 could cause misalignment or undesirable misfeeding of a sheet of material at an upstream thermal-forming machine. Alternatively, any pattern of fingers 89 can be provided with any finger shape suitable to convey material. Finger 89 can even form a paddle in one version.

In this manner, a web of scrap material 12 leaves a trim press (not shown) at a delivery, or line speed. Feed roll 78 preferably is driven by a dedicated servo motor drive 162, via shaft 166 at substantially such line speed (see FIGS. 1–4). Fingers 89 are preferably sharp enough to perforate the sheet as it passes between drum 88 and feed plate 79, holding the sheet securely in place, as shown in FIG. 5. In this manner, servo-driven feed roll 78 delivers the web of material at a desired line speed into scissor rolls 42 and 44 where it is shredded at a much higher rate. By perforating the web with perforations 15, as shown in FIG. 6, via fingers 89 (see FIG. 5) and delivering it to rolls 42 and 44 in a speed regulated manner via feed roll 78, web 12 is not otherwise pulled on by rolls 42 and 44, which might otherwise place tension on web 12 that could interfere with operation of a trim press machine (or other processing machine) placed upstream of the apparatus of this invention. Furthermore, rolls 42 and 44 can be run at a speed that is optimal for shredding the material (most likely a higher speed), not for feeding the material (usually a lower speed), since feed roll 78 is operated to control the feed speed of the web into the apparatus. Hence, the apparatus of this invention can be run substantially at a desired line speed, preventing uneven or jerky feeding of a web of material into the apparatus.

Motor 162 is run via computer control at a desired speed to draw a web of material into the apparatus of this invention with a desired line speed, irrespective of the speed with which scissor rolls 42 and 44 are run. Preferably, motor 162 drives the web at a line speed of a process machine directly upstream of the apparatus of this invention. For example, feed roll 78 can be run to move a web at the same speed as a trim press which produces and feeds the web. Typically, a trim press would move a web intermittently. Similarly, feed roll 78 can be run at the same intermittent operating speed. Motor 180 is preferably run at a constant speed, and can also be computer controlled, if needed.

Although motor 102 can be a servo-drive motor, alternatively it can be a standard motor having an adjustable operating speed. Preferably, the operating current (amperage) used by motor 102 is monitored in order to determine whether or not the capacity of scissor rolls 42 and 44 is being exceeded by material being severed therebetween. By monitoring the current drive motor 102, the feed rate of feed roll 78 can be reduced by reducing the speed of motor 162 when excessive current draw is detected on motor 102. In this manner, the overloading of motor 102 can be reduced, or eliminated, by controlling the feed rate of material via feed roll 78.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus for comminuting solid waste material, comprising:

a frame having an enclosure with an entrance for initially receiving solid waste material;

a set of overlapping scissor rolls rotatably mounted within the enclosure for shearing the waste material into subdivided pieces when the material passes between the scissor rolls;

a feed roll rotatably carried by the frame for directing the waste material to the scissor rolls;

a separator screen carried by the frame in association with the at least one of the scissor rolls and having a plurality of apertures of a predetermined size for separating pieces having a size less than the predetermined size to pass therethrough to a shear outtake manifold for separation while preventing large subdivided pieces having a size greater than the predetermined size from passing therethrough; and a recycle manifold section provided within the enclosure downstream and above the scissor rolls, a first stripper plate and a second stripper plate carried by the frame in association with the set of scissor rolls and cooperating to define the recycle manifold section;

subdivided pieces being passed through the set of scissor rolls and delivered to the recycle manifold section downstream and above the scissor rolls, wherein the subdivided pieces collected within the recycle manifold section pass over one of the stripper plates to the feed roll for further delivering and shearing the subdivided pieces along the feed roll and between the set of scissor rolls.

2. The apparatus of claim 1 wherein the entrance has:

(a) a shear intake manifold communicating with the entrance for receiving the solid waste material upstream of the feed roll and directing the waste material via the feed roll to the scissor rolls; and (b) a shear outtake manifold downstream of the separator screen for receiving the subdivided waste material pieces from the scissor rolls as the material passes between the scissor rolls and the separator screen;

(c) the apparatus further comprising a pneumatic conveyor mounted on the frame communicating with the shear outtake manifold, the screen, and the shear intake manifold for generating an airstream of sufficient velocity to:

(1) remove the subdivided pieces from the shear outtake manifold, (2) entrain the subdivided pieces in the airstream, and (3) impinge the subdivided pieces against the screen to direct the small subdivided pieces through the screen.

3. The apparatus of claim 1 wherein the feed roll further comprises a computer-controlled servo motor for driving the feed roll at a desired line speed.

4. The apparatus of claim 1 wherein at least a portion of the subdivided pieces is sifted between the set of overlapping scissor rolls by passing the portion of subdivided pieces from the recycle manifold section above the scissor rolls, between the scissor rolls, to below the scissor rolls where the portion of subdivided pieces is either separated along the separator screen, or is further sheared into smaller subdivided pieces between the set of scissor rolls.

5. An apparatus for comminuting waste material into pieces having a size less than a predetermined size, comprising:

a frame having an enclosure with an entrance opening for receiving the waste material;

a set of overlapping scissor rolls rotatably mounted on the frame for shearing the waste material into smaller pieces as the material is passed between the scissor rolls;

a feed roll for receiving the material from the entrance and directing the material between the scissor rolls;

a screen carried by the frame within the enclosure in association with the scissor rolls, downstream of the feed roll, for permitting undersized smaller pieces of a size less than the predetermined size to pass therethrough and for preventing oversized smaller pieces of a size greater than the predetermined size from passing therethrough, the oversized smaller pieces being sheared into further subdivided pieces by passing between the scissor rolls; and a recycle manifold downstream of the scissor rolls and communicating with the feed roll, the recycle manifold configured to receive the subdivided pieces passed between the scissor rolls, at least some of the subdivided pieces being delivered to the feed roll where they are again directed between the scissor rolls.

6. The apparatus of claim 5 wherein the set of overlapping scissor rolls, the recycle manifold and the feed roll cooperate to form a recycle conveyor operable to deliver subdivided pieces of material back into the scissor rolls for shearing into further subdivided pieces, the recycle conveyor operable to continue re-delivering the subdivided pieces until they become undersized smaller pieces that are separated by the screen.

7. The apparatus of claim 5 further comprising a shear outtake manifold downstream of the screen for receiving the undersized subdivided pieces, and a pneumatic conveyor mounted on the frame communicating with the shear outtake manifold and the screen for generating an airstream of sufficient velocity to remove the subdivided pieces from the shear outtake manifold, entrain the subdivided pieces in the airstream, impinge the subdivided pieces against the screen to direct the small subdivided pieces through the screen, the large subdivided pieces being carried along the screen by the overlapping scissor rolls for recycling through the scissor rolls to be further subdivided therebetween.

8. The apparatus of claim 5 wherein the screen comprises a sorting plate having a bi-concave configuration with a plurality of perforations for sorting the undersized smaller pieces of a size less than the predetermined size to pass therethrough.

9. A comminuting apparatus, comprising:

a frame having an entrance opening for receiving waste material;

a set of overlapping scissor rolls rotatably carried by the frame;

a feed roll rotatably carried by the frame and operative to receive the waste material from the entrance opening and direct the waste material between the scissor rolls, the scissor rolls operative to shear the waste material into pieces as the material is passed between the scissor rolls;

a screen carried by the frame in association with the scissor rolls and operative to permit undersized smaller pieces of a size less than the predetermined size to pass therethrough and to prevent oversized pieces of a size greater than the predetermined size from passing therethrough; and a recycle manifold provided downstream of the scissor rolls, the recycle manifold configured to receive the pieces and pass the pieces between at least one of the scissor rolls and the screen.

10. The comminuting apparatus of claim 9 wherein the recycle manifold communicates with the feed roll.

11. The comminuting apparatus of claim 10 wherein at least some of the oversized pieces are delivered to the feed roll from the recycle manifold where they are again directed between the scissor rolls.

12. The comminuting apparatus of claim 9 wherein the oversized pieces are delivered from the recycle manifold between the screen and one of the scissor rolls, and between the scissor rolls to shear the waste material into further subdivided pieces as the material is passed between the scissor rolls.

13. The comminuting apparatus of claim 9 wherein the screen comprises a bi-concave perforated plate provided beneath and adjacent to the set of overlapping scissor rolls.

14. The comminuting apparatus of claim 13 wherein the bi-concave perforated plate conforms generally in nested relation with a bottom edge configuration of the set of overlapping scissor rolls.

15. The comminuting apparatus of claim 9 wherein the screen is provided beneath the set of overlapping scissor rolls, and the recycle manifold is provided above the set of overlapping scissor rolls.

16. The comminuting apparatus of claim 15 wherein at least some of the undersized smaller pieces pass downwardly from the recycle manifold, between the set of overlapping scissor rolls, and through the screen.

* * * * *

UNITED STATES PATENT AND TRADEMARK OFFICE

CERTIFICATE OF CORRECTION

PATENT NO. : 5,893,523

DATED : April 13, 1999

INVENTOR(S) : Jere F. Irwin

It is certified that error appears in the above-indentified patent and that said Letters Patent is hereby corrected as shown below:

Col. 3, line 36, delete "pass between", and insert --passing between--.

Col. 4, line 54, delete "th e scissor", and insert --the scissor--.

Col. 4, line 54, delete "further include", and insert --further includes--.

Col. 9, line 31, delete "Finger 89 can", and insert --Each finger 89 can--.

Signed and Sealed this

Twenty-sixth Day of October, 1999

*Attest:*

Q. TODD DICKINSON

*Attesting Officer*

*Acting Commissioner of Patents and Trademarks*